US005099824A

United States Patent [19]

Mason

[11] Patent Number: 5,099,824

[45] Date of Patent: Mar. 31, 1992

[54] EASY-PLY BOILER

[76] Inventor: Edward H. Mason, 5000 Sullivan Rd. SW., Powder Springs, Ga. 30073

[21] Appl. No.: 424,602

[22] Filed: Oct. 20, 1989

[51] Int. Cl.[5] ..... E01C 19/45

[52] U.S. Cl. ..... 126/343.5 R; 122/13.1

[58] Field of Search ..... 122/13 R, 32; 126/377, 126/369, 343.5 R, 268

[56] References Cited

U.S. PATENT DOCUMENTS 3,270,741 9/1966 Petlak ..... 126/343.5 R
3,386,435 6/1968 Heller ..... 126/343.5 R
4,418,681 12/1983 Moody ..... 126/343.5 R
4,474,311 10/1984 Petrecca ..... 126/343.5 R
4,724,824 2/1988 McCoy et al. ..... 126/369

*Primary Examiner*—Edward G. Favors
*Assistant Examiner*—Denise L. F. Gromada
*Attorney, Agent, or Firm*—Oldham & Oldham Co.

[57] ABSTRACT

The purpose of the Easy-Ply Boiler is to warm tar, roofing or other building materials in a boiler. The boiler holds water that is heated by gas burners. The water boils and warms the tar, roofing or other building materials.

10 Claims, 4 Drawing Sheets

EASY-PLY BOILER

SUMMARY OF THE INVENTION

The Easy-Ply Boiler is a product that warms tar, roofing or other building materials by heating them in a water boiler.

DETAILED DESCRIPTION OF THE INVENTION

The purpose of the Easy-Ply Boiler is to warm tar, roofing or other building materials.

Figure 1A:
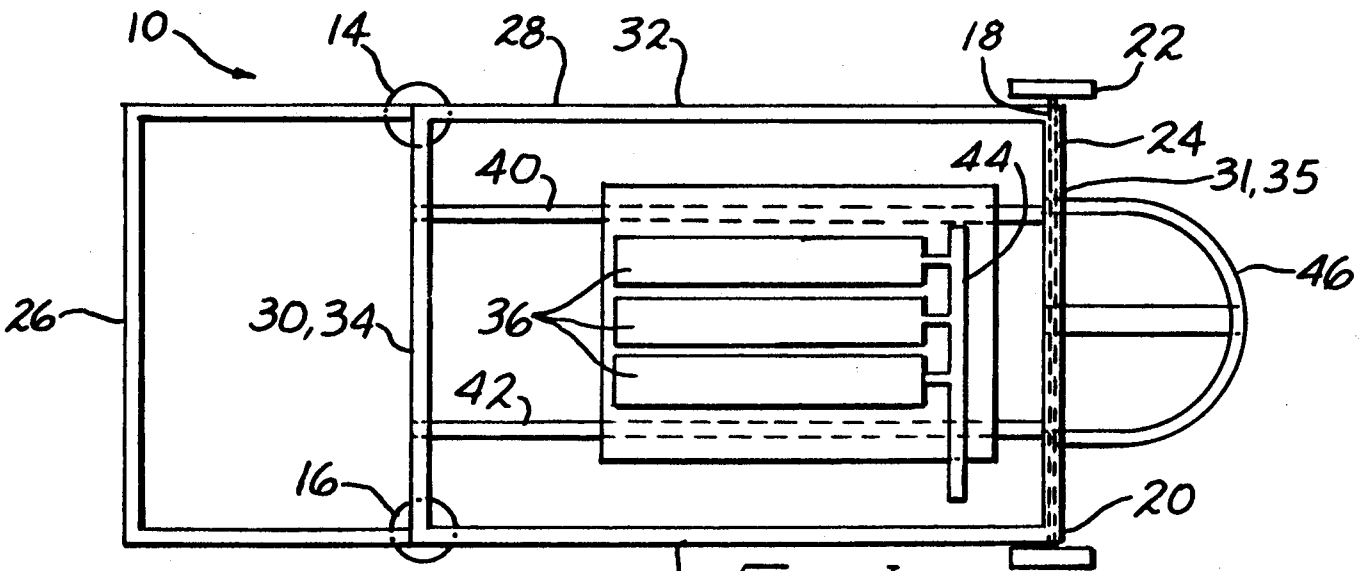
FIG. 1*a* is a top view of the base as shown in FIG. 1.
Figure 1:
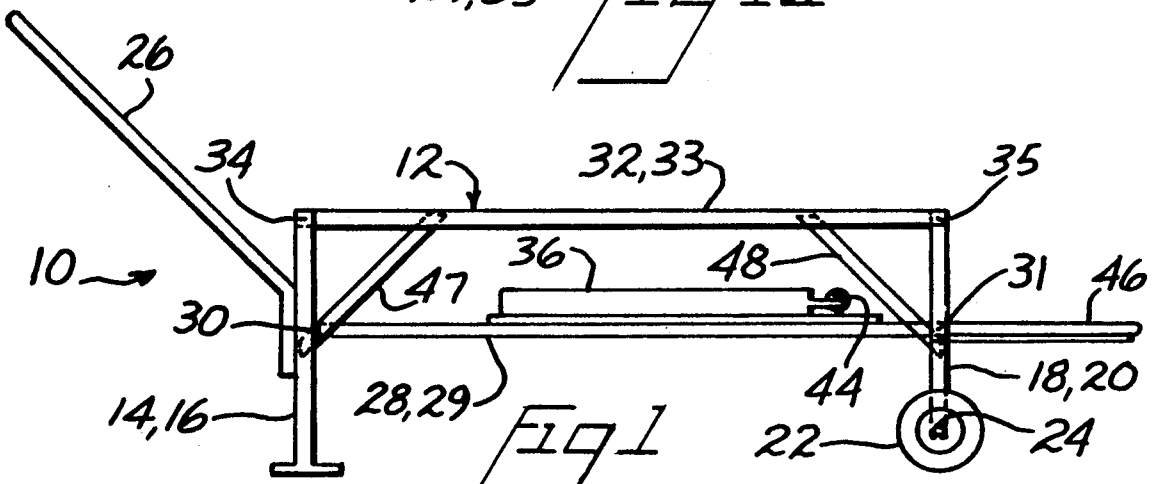
FIG. 1 is a front view of the base of the boiler.

Referring now to the drawings, FIGS. 1 and 1*a* show the base portion 10 of the boiler. The base portion 10 includes a frame structure 12 comprised of pedestal legs 14 and 16 as well as legs 18 and 20 which may include wheels 22 mounted thereon or on an axle 24 disposed therebetween. The wheels 22 allow relative ease of portability of the base portion by lifting of legs 14 and 16 up off the ground surface by means of handle 26 coupled thereto. Extending between legs 14 16, 18 and 20 are burner support means comprising spaced apart longitudinally extending frame members 28 and 29 along with transversely extending frame members 30 and 31. Also, container support means comprising spaced apart longitudinally extending frame members 32 and 33 along with transversely extending frame members 34 and 35 act as a supporting structure for the container of the boiler assembly as will be hereinafter described.

Also, associated with the base portion 10 is a plurality of burners 36 which may be supported on a plate 38 which itself is supported on a plurality of longitudinally extending supporting means 40 and 42 extending between frame members 28 and 29. A fuel or gas connection 44 is coupled to the plurality of burners 36 and to a source of fuel (not shown) such as a propane gas or the like, to produce an adjustable flame from the burners 36. The source of fuel may be stored in a conventional container such as a fuel tank which itself may be supported on a fuel tank supporting means 46 disposed on the base portion 10. Also shown in FIG. 1, are brace supports 47 and 48 which may be used to strengthen and rigidify the base portion 10.

Figure 2A:
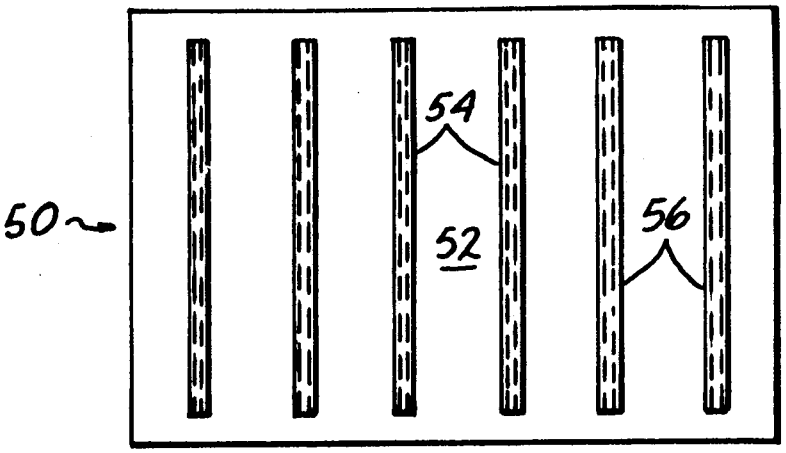
FIG. 2*a* is a top view of the container a shown in FIG. 2.
Figure 2B:
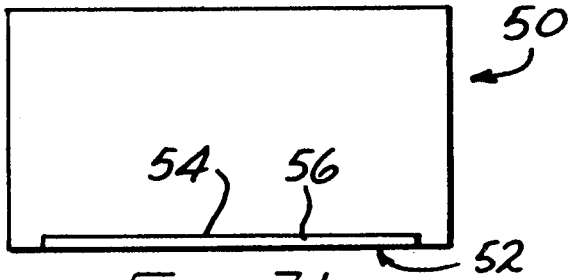
FIG. 2*b* is an end view of the container as shown in FIG. 2.
Figure 2:
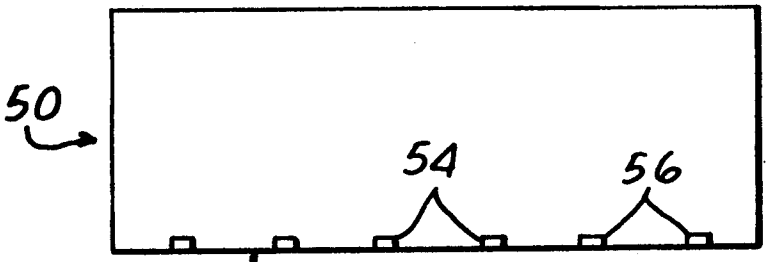
FIG. 2 is a front view of the container of the boiler.

Turning now to FIGS. 2–2*b* a close view of the steel container 50 and specifically the hollow tubes at the bottom thereof are shown.

The container 50 is formed as a box having a bottom 52 and side walls to define a predetermined volume within the container 50.

The steel container 50 is designed to hold a volume of water (see FIG. 2) and is covered by a lid. The container is positioned on the base 10 so as to be supported by frame members 32, 33, 34 and 35 such that it will be disposed above the burners 36 for heating of the water within the container 10. In a preferred embodiment, the container is designed to hold six 5-gallon drums of tar, roofing or other building materials which are to be warmed.

The container 50 also has a plurality of means for positioning the drums of tar, roofing or other building materials such as bulk caulking above the bottom floor 52 of the container 50 shown as ribs 54 disposed in spaced apart relationship along the floor 52. The ribs 54 will support each drum of roofing material above floor 52 to allow water disposed in the container 50 and heated by burners 36 to circulate around and beneath the drums of roofing materials or the like. The ribs 54 may be U-shaped strips having the open end disposed against the floor 52 so as to provide a hollow channel 56 in each of the ribs 54 through which water or the heating fluid may circulate.

Figure 3A:
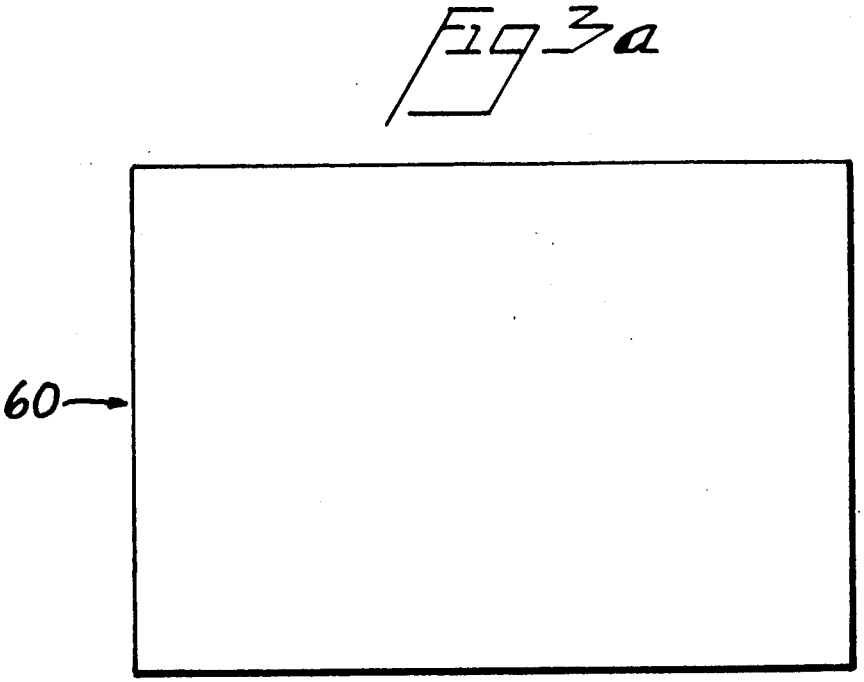
FIG. 3*a* is a top view of the lid as shown in FIG. 3.
Figure 3:
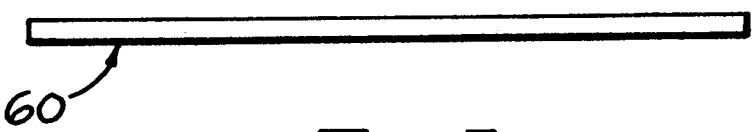
FIG. 3 is a front view of the lid of the boiler.
Figure 3B:
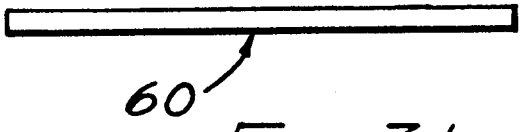
FIG. 3*b* is an end view of the lid as shown in FIG. 3.

Turning now to FIGS. 3–3*b*, a lid 60 is provided to enclose the volume of the container 50 during use thereof. The lid 60 can be hinged to the container 50 if desired for easier handling and use of the boiler. It should be recognized that the lid will allow more efficient heating of the water and therefore the drums of tar, roofing or other building materials disposed in the container 50 which are to be warmed for use.

Figure 4:
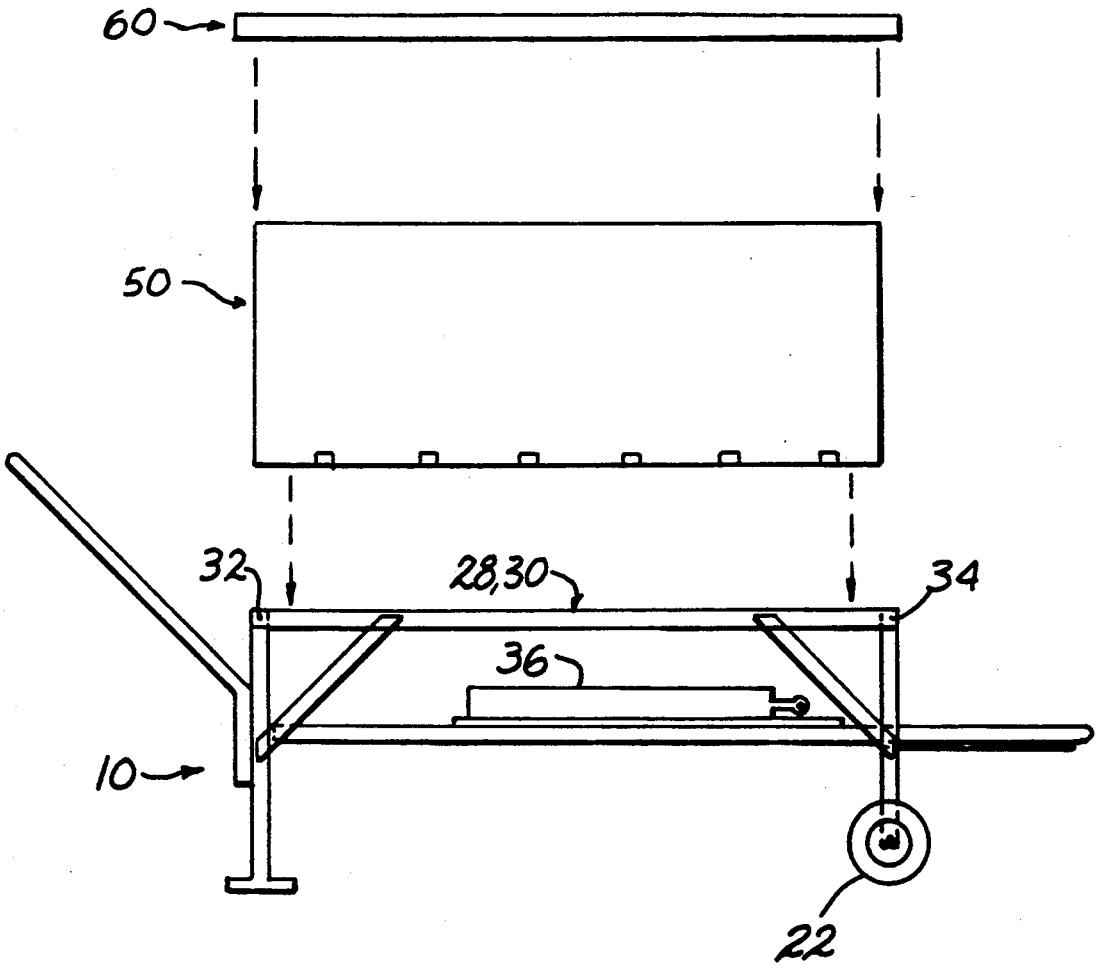
FIG. 4 is an exploded front view of the Easy-Ply Boiler.

Turning now to FIG. 4, the boiler including base 10, container 50 and lid 60 are shown as they are assembled for use. The container 50 will be supported on the upper frame members 32, 33, 34 and 35 of the base 10 so as to position the container above the burners 36. The entire assembly is made portable by means of wheels 22 to facilitate transporting the assembly from job to job as well as repositioning the assembly during use.

In the preferred embodiment, the process is to put six-gallon drums into the container 50 and fill the container ¾ full with water or other heating fluid. The next step is to put the lid 60 over the container 50 and light the burners 36, which are positioned below the container in base 10 and fueled by natural gas.

The concept is to heat up the water which is allowed to circulate around the drums of roofing material of the like which will warm the tar, roofing or other building materials for use even in cold weather.

What is claimed is:

1. A portable apparatus for warming of materials comprising, a portable base portion, heating means associated with said base portion, a container having a bottom panel and side walls for carrying receptacles of materials to be warmed and a volume of heating fluid therein, said container being supportable on said base portion above said heating means, said receptacles of materials to be warmed being positioned in said container within said heating fluid;

means in said container for elevating said receptacles of material to be warmed above said bottom panel to allow said heating fluid to circulate around said receptacles, wherein said container and said heating fluid are warmed by said heating means thereby warming said materials.

2. A portable apparatus as in claim 1, wherein, said heating means comprises a plurality of gas burners and said base portion includes means for supporting a source of fuel for said gas burners.

3. A portable apparatus as in claim 1, wherein said means for elevating said receptacles above said bottom panel are a plurality of ribs positioned on said bottom panel for supporting said receptacles of materials to be warmed above said bottom panel of said container.

4. A portable apparatus as in claim 1, wherein, said container is adapted to carry a predetermined volume of said heating fluid to allow said heating fluid to circulate around the entirety of said receptacles of materials to be warmed.

5. A portable apparatus as in claim 1, wherein said container further includes a lid for enclosing said volume to facilitate warming of the heating fluid and materials to be warmed therein.

6. A portable apparatus as in claim 3, wherein, said ribs are hollow to allow circulation of said heating fluid therethrough.

7. A method of warming roofing materials comprising the steps of:

providing a portable base portion having heating means associated therewith and a container having a bottom panel and side walls for carrying receptacles of materials to be warmed and being supported by said base portion, filling said container with an amount of a heating fluid, positioning said receptacles of materials to be warmed in said heating fluid within said container and above said bottom panel, and heating said container and heating fluid contained therein using said heating means associated with said base portion for warming of said receptacles of materials disposed in said heating fluid within said container.

8. The method of claim 7, wherein, said materials to be warmed are supported off the bottom panel of said container by means of a plurality of ribs to enable circulation of said heating fluid around the materials to be warmed.

9. The method of claim 7, wherein, said heating means are a plurality of gas burners and a source of fuel for said burners is carried by said base portion.

10. The method of claim 7, wherein, a lid is provided for said container to facilitate warming of said roofing materials.

* * * * *